US011472608B2

(12) United States Patent
Shields et al.

(10) Patent No.: US 11,472,608 B2
(45) Date of Patent: Oct. 18, 2022

(54) CONTAINER FITTING

(71) Applicant: Joanna Shields, Phoenix, AZ (US)

(72) Inventors: Joanna Shields, Phoenix, AZ (US); Philip M. Blank, Phoenix, AZ (US)

(73) Assignee: Joanna Shields, Phoenix, AZ (US)

( * ) Notice: Subject to any disclaimer, the term of this patent is extended or adjusted under 35 U.S.C. 154(b) by 609 days.

(21) Appl. No.: 16/137,033

(22) Filed: Sep. 20, 2018

(65) Prior Publication Data

US 2019/0023462 A1 Jan. 24, 2019

Related U.S. Application Data

(63) Continuation-in-part of application No. 15/357,601, filed on Nov. 21, 2016, now abandoned.

(51) Int. Cl.

| | |
|---|---|
| ***B65D 41/04*** | (2006.01) |
| ***B65D 47/06*** | (2006.01) |
| ***B65D 51/24*** | (2006.01) |
| ***B65D 43/02*** | (2006.01) |
| ***B65D 41/20*** | (2006.01) |

(52) U.S. Cl.

CPC ..... *B65D 47/06* (2013.01); *B65D 41/04* (2013.01); *B65D 41/20* (2013.01); *B65D 43/0225* (2013.01); *B65D 51/245* (2013.01); *B65D 2231/022* (2013.01); *B65D 2251/08* (2013.01)

(58) Field of Classification Search

CPC ..... B65D 2251/08; B65D 41/04; B65D 43/0225; B65D 2231/022; B65D 47/06; B65D 51/245; A47G 21/18; A47G 19/2272

USPC ..... 220/287, 709, 288, 259.3, 780; 215/387, 215/388, 389, 319, 229

See application file for complete search history.

(56) References Cited

U.S. PATENT DOCUMENTS

| | | | | |
|---|---|---|---|---|
| 2,262,021 | A * | 11/1941 | Lockwood | B65D 41/0492 215/334 |
| 2,309,308 | A | 1/1943 | Gibbs | |
| 3,405,831 | A * | 10/1968 | Hudson | B65D 41/0471 215/330 |
| 4,476,987 | A * | 10/1984 | Nolan | B65D 41/3466 215/319 |
| 4,583,668 | A | 4/1986 | Maynard, Jr. | |
| 5,195,561 | A * | 3/1993 | Wilson | B60C 29/06 138/89.2 |
| 6,390,315 | B1 | 5/2002 | Giddings et al. | |
| 6,408,887 | B2 | 6/2002 | Rahimzadeh et al. | |

(Continued)

*Primary Examiner* — Don M Anderson
*Assistant Examiner* — Elizabeth J Volz
(74) *Attorney, Agent, or Firm* — Woods Oviatt Gilman LLP; Dennis B. Danelia, Esq.

(57) ABSTRACT

A fitting for affixing to a mouth of a receiving container comprises a tubular body having a closed top end, a bottom end and a side wall extending between the closed top and bottom ends and having an inner surface and an outer surface. The inner surface includes a circumferential surface wherein the circumferential surface includes a plurality of inwardly extending, randomly placed nodes to engage an external surface of the mouth of the receiving container. A plug seal extending from the closed top end is spaced apart from circumferential surface to form a land area seal. The closed top end may further include an aperture adapted to permit passage of a straw therethrough.

15 Claims, 6 Drawing Sheets

(56) References Cited

U.S. PATENT DOCUMENTS

| | | | | |
|---|---|---|---|---|
| 6,491,175 | B1 * | 12/2002 | Taha | B29C 45/262 215/252 |
| 2004/0089629 | A1 * | 5/2004 | Villaescusa | B65D 17/4012 215/388 |
| 2009/0120894 | A1 * | 5/2009 | Kario | A61J 11/04 215/11.1 |
| 2009/0200259 | A1 * | 8/2009 | Baughman | B65D 39/082 215/217 |
| 2012/0217178 | A1 * | 8/2012 | Rohr | B65D 51/2864 206/219 |
| 2013/0175285 | A1 * | 7/2013 | Elliot | B65D 41/3423 220/797 |
| 2014/0339190 | A1 | 11/2014 | Lemke et al. | |
| 2015/0166245 | A1 * | 6/2015 | Elias | A47G 19/2288 220/739 |

* cited by examiner

CONTAINER FITTING

CROSS-REFERENCE TO RELATED APPLICATIONS

This application is a continuation-in-part of pending U.S. patent application Ser. No. 15/357,601, filed Nov. 21, 2016, titled CONTAINER FITTING, which is incorporated herein by reference.

TECHNICAL FIELD

The present invention relates to container fittings; more particularly, to container fittings capable of being releasably mounted to more than one size container opening; and most particularly, to container fittings including a leak-resistant aperture adapted to permit passage of a disposable, standard size drinking straw therethrough.

BACKGROUND OF THE INVENTION

Container fittings and caps coupled to container mouth openings are known in the art. Typically, containers are closed using a dedicated fitting/cap, with one class of containers holding liquid refreshments such as water, soft drinks and sport/energy drinks. To partake of the liquid within the container, particularly when a secondary container is unavailable, a user needs to remove the fitting/cap and drink directly from the bottle mouth opening. Such direct drinking may be difficult for young children and may cause issues for adults, such as inadvertent spillage or smearing of lipstick. Direct drinking may also pose a danger by causing an unnecessary distraction while driving. Moreover, to ease drink accessibility, a user may decide not to replace the fitting/cap in between sips thereby necessitating that the container remain in an open state. Thus, any tipping or inversion of the container may result in spilling, and potentially catastrophic emptying, of the container contents.

As an attempt to alleviate the above shortcomings of conventional caps/fitting, there are a number of alternative container fittings available. However, each of these fittings suffers from one or more significant drawbacks. For instance, one example of a typical fitting includes a threaded fitting with a resealable nozzle. The threaded fitting is sized to fit a standard disposable water bottle. Its nozzle may be opened using fingers or teeth so that liquid may be poured or squirted into the mouth and then closed when not in use to prevent spilling.

Another example of a bottle fitting is a "spout adapter for water bottle" sold by i play Inc. of Asheville, N.C. A reusable/non-disposable, soft nipple is removably connected to a screw-on cap; the cap is adaptable to a fit a standard water bottle mouth of approximately 25 mm. The cap is reversible and sized to fit water bottles having the same diameter mouth but different thread sizes. The nipple sold with the cap has a diameter almost equal to the diameter of the cap and, if removed or lost, leaves the bottle completely open for spilling if tipped. Further, since the nipple is non-disposable, it may be difficult to keep the nipple clean and ready for repeated use.

To further complicate matters, not all bottles suitable for an alternative container fitting have the same mouth opening diameter. For instance, water bottles typically have a mouth opening diameter (and therefore associated fitting/cap) of approximately 25 mm. Juice and sport/energy drink bottles typically come with mouth diameters of approximately 35 mm. Further, while maintaining a common opening diameter such as 25 mm or 35 mm, many bottles use a non-standard thread size (pitch or threads per inch). As a result, since the above alternative fittings are dedicated to a single container mouth diameter or thread size, the prior art alternative fittings described above cannot be interchangeably used with various commonly used bottles.

Alternative fittings have been developed to accommodate two or more differing mouth opening diameters. One such fitting is disclosed in U.S. Pat. No. 6,390,315. The disclosed fittings are arranged to include two serially stacked openings of varying diameters. The stacked openings are arranged such that the widest diameter opening is positioned at the bottom of the fitting, with the smaller diameter opening in direct communication above. As a result, such a fitting may fit containers having different mouth diameters. This proposed solution, however, also suffers a number of drawbacks. For instance, the fitting must be proportioned so that each diameter opening may, when needed, engage the container mouth opening. However, due to the needed threaded length, if the axial length of the bottom opening is of a length that the fitting engages the container body prior to the smaller fitting diameter engaging the container mouth, the fitting cannot be properly mounted onto the container.

Accordingly, what is needed in the art is a container fitting which addresses the above recited limitations in the art. What is needed is a container fitting that can mount onto containers having differences in mouth diameter and thread size. What is further needed is a container fitting that is usable with a standard 6 mm diameter disposable straw, is leak-resistant while also allowing the container contents to be readily available to a user in a safe, clean and accessible manner.

SUMMARY OF THE INVENTION

Briefly described, a fitting for affixing to a mouth of a receiving container comprises a tubular body having a top end, a bottom end and a side wall extending between the top and bottom ends and having an inner surface and an outer surface. A partition is integrally formed on the inner surface between the top end and the bottom end. The partition divides the body into an open top region and an open bottom region with the inner surface of the open top region having a top threading and the inner surface of the open bottom region having a bottom threading. The partition further includes an aperture therein adapted to permit close fitting passage of a standard size disposable straw therethrough from the open top region to the open bottom region. The top threading may have a different pitch or number of threads per inch or both than the bottom threading.

A further embodiment of a side wall that has a planar surface substantially normal to the open top and bottom ends such that the side wall defining the open top region has a thickness greater than a thickness of the side wall defining the open bottom region. As a result, the open top region has a smaller open internal diameter than an open internal diameter of the bottom region. In an alternative embodiment, the outer surface of the side wall has a stepped profile so that the thickness of the side wall defining the open top region is substantially the same thickness as the side wall defining the open bottom region.

Yet another embodiment of a fitting according to the present invention includes a partition that is rigid yet flexible and the aperture is substantially leak-resistant. Moreover, the open top end may accommodate a container mouth having an external diameter of 25 mm and the open bottom end may accommodate a container mouth having an external diameter of 35 mm. The outer surface of the body may also be knurled.

In yet another embodiment of a fitting according to the present invention, the inner surface of the side wall includes a plurality of inwardly extending nodes. Each node may have a generally conical shape and may be randomly placed about the circumference of the inner surface and operate conjunctively with one another so as to secure the container fitting to the receiving container. By being discontinuous and randomly spaced, the individual nodes ensure secure engagement of the fitting to the container regardless of thread type or pitch.

In a further embodiment of a fitting in accordance to the present invention the partition may further include a plug seal extending perpendicularly outwardly from the partition so as to form a land area seal on the top surface of the partition. The plug seal may also have a sloped outer wall surface wherein the top end of the plug seal has a smaller thickness than its base. Thus, as the mouth opening of a receiving container is threadably mounted to the outwardly extending nodes, the container's mouth orifice may seat within the land area seal while the outer wall surface engages the inner wall of the mouth opening. Alternatively, if the mouth orifice cannot seat within the land area seal, the sloped outer wall surface will tend to wedge the mouth orifice between the sloped outer wall surface and the nodes to tightly grip the container fitting and to enhance its seal.

In each of the above embodiments, the fitting may be constructed of any suitable material, but in a preferred embodiment is constructed as a unitary body from a material selected from the group consisting of silicone, polyethylene, high density polyethylene, low density polyethylene, polyethylene terephthalate, polypropylene, a copolyester and combinations thereof. The fitting may also be color coded or branded to aid in the ready identification of the fitting's opening sizes.

BRIEF DESCRIPTION OF THE DRAWINGS

The above-mentioned and other features are advantages of this invention, and the manner of attaining them, will become apparent and be better understood by reference to the following description of the invention in conjunction with the accompanying drawings, wherein.

DESCRIPTION OF THE PREFERRED EMBODIMENTS

Figure 1:
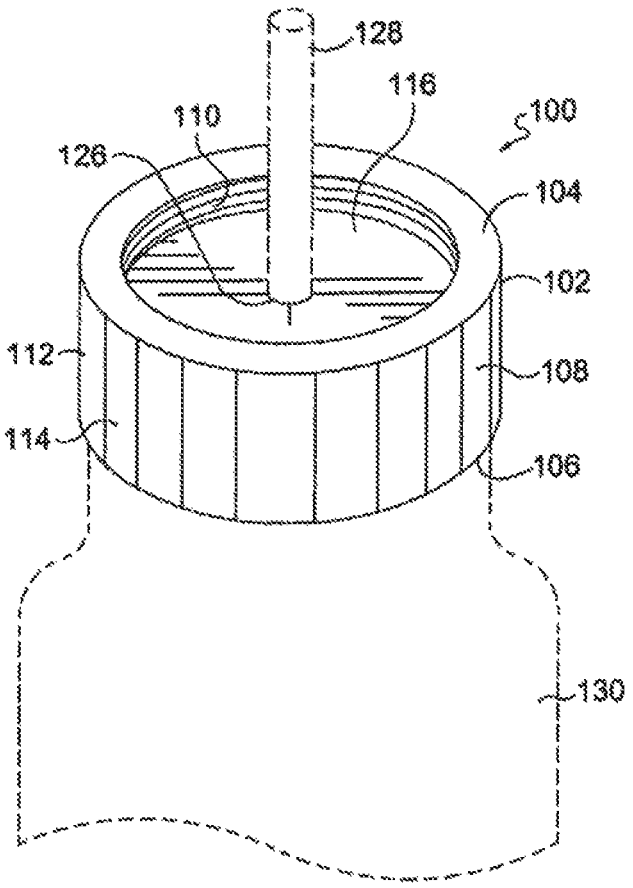
FIG. 1 is a perspective view of an embodiment of a container fitting in accordance with the invention mounted onto a container.

Referring to the drawings in detail, and specifically to FIGS. 1 through 4, container fitting 100 is generally comprises a tubular body 102 having a top end 104, a bottom end 106 and a side wall 108 extending therebetween. Side wall 108 has an inner surface 110 and an outer surface 112. Outer surface 112 may be a smooth surface or may include knurls 114. Knurls 114 may extend along the longitudinal axis of body 102 from top end 104 to bottom end 106, or any intermediate distance therebetween, with successive knurls being in parallel spaced relation to one another.

Partition 116 may be integrally formed on inner surface 110 a spaced distance from top end 104 and bottom end 106. In this manner, partition 116 divides body 102 into an open top region 118 and an open bottom region 120. Inner surface 110*a* of open top region 118 may be sized as diameter $D_t$. while inner surface 110*b* of open bottom region 120 may be sized as diameter $D_b$, wherein $D_b$ is greater than $D_t$. In one aspect of the invention, inner surfaces 110*a* and 110*b* may be smooth surfaced so as to offer a slight interference fit with the mating container mouth. In another aspect of the invention, inner surfaces 110*a* and 110*b* may include a series of flexible circular ridges formed axially along the circumferences of the surfaces so as to offer an interference fit with the mating container mouth. In yet another aspect of the invention, inner surface 110*a* of open top region 118 may include threading 122 while inner surface 110*b* of open bottom region 120 may include bottom threading 124. In accordance with an aspect of the invention, top threading 122 may have a different pitch or number of threads per inch or both than bottom threading 124. Partition 116 may further include an aperture 126 appropriately sized through which a standard size disposable straw 128 may close-fittedly pass from the environment, through partition 116 and into the interior of container 130. As for example, aperture 126 may be sized to close-fittedly receive a disposable drinking straw having a diameter of approximately 6. mm as distributed by Wal-Mart Stores, Inc. of Bentonville, Ark.

In accordance with an aspect of the invention, partition 116 is formed of a rigid yet flexible material such that aperture 126 is in a substantially closed position when straw 128 is absent, but also forms around the circumference of straw 128 when the straw is inserted and resides within aperture 126. In this manner, container fitting 100 may be substantially leak-resistant. That is, container fitting 100 may resist leaking of fluid within container 130 should container 130 be tipped or inverted. It should be understood that, should container 130 be tipped or inverted for too long a time period, or should sufficient back pressure be exerted upon the fluid in container 130, some small amount of fluid may leak through aperture 126. However, even in this case, the amount of fluid loss and/or the rate of fluid loss would be substantially less than should container 130 not be outfitted with container fitting 100 whereby catastrophic spillage may occur, potentially including the entire fluid volume resident within container 130.

Following removal of straw 128, partition 116 may resiliently close aperture 126 to reform the leak-resistant closure. It should be understood that a completely sealed closure is not required or, in the case of certain embodiments, expected. Rather, aperture 126 may remain partially open but have such opening be small enough so as not to disrupt the intermolecular forces within the fluid within container 130 thereby promote resistance to leaking.

By way of example, container 130 may be a bottle of water wherein aperture 126 may maintain a sufficiently small opening such that the intermolecular adhesive forces between water molecules are maintained proximate aperture 126. These intermolecular forces may enable a droplet of water to not readily pass through aperture 126. As described above, however, should the water bottle be inverted or tipped for a sufficient amount of time or sufficient pressure be applied to the bottle or water within, the intermolecular adhesion of the water droplet at the aperture may be overcome thereby resulting in leakage of the water.

As can be seen in FIGS. 1 through 4, in accordance with an aspect of the invention, side wall 108 may have a planar surface which is substantially normal to the plane formed by top 104 and bottom 106 ends. As a result, side wall 108 may include a top side wall portion 108*a* such that the side wall of open top region 118 has a thickness $T_t$ which is greater than a thickness $T_b$ of side wall portion 108*b* which defines open bottom region 120. Open top region 118 has a smaller open internal diameter $D_t$ than the open internal diameter $D_b$ of the open bottom region 120. As described above, open top region 118 may include top threading 122 while open bottom region 120 includes bottom threading 124. In this manner, container fitting 100 may be selectively mountable onto containers 130 which have different mouth diameters.

Figure 3:
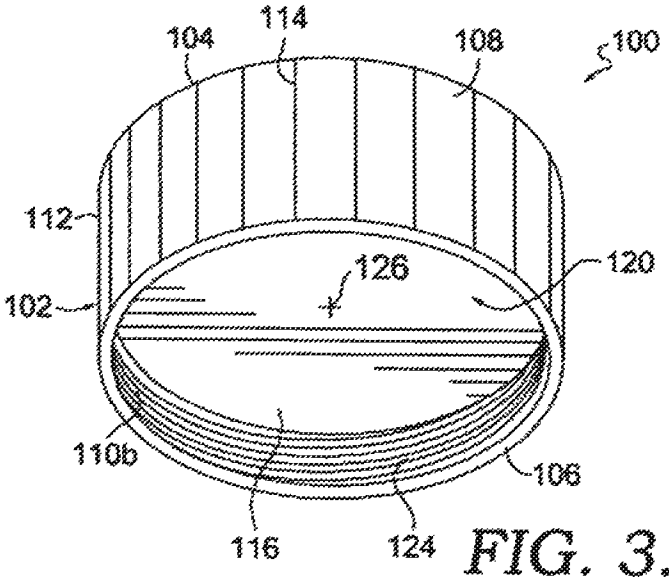
FIG. 3 is a bottom perspective view of the container fitting shown in FIG. 1.
Figure 2:
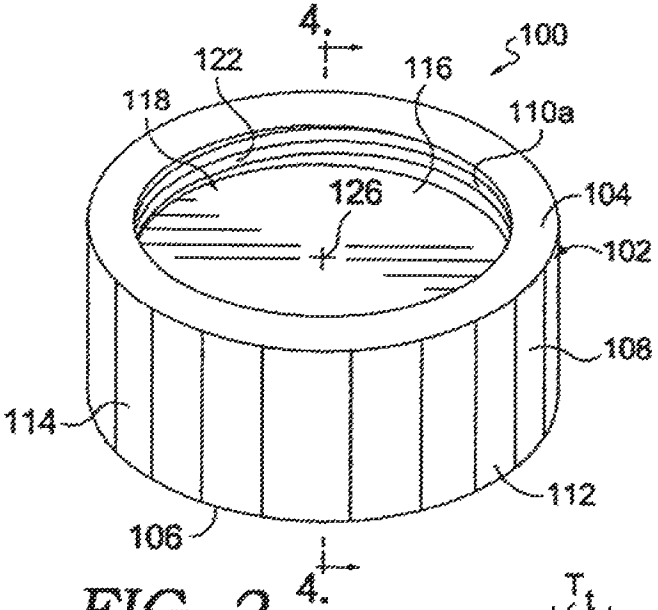
FIG. 2 is a top perspective view of the container fitting shown in FIG. 1.
Figure 4:
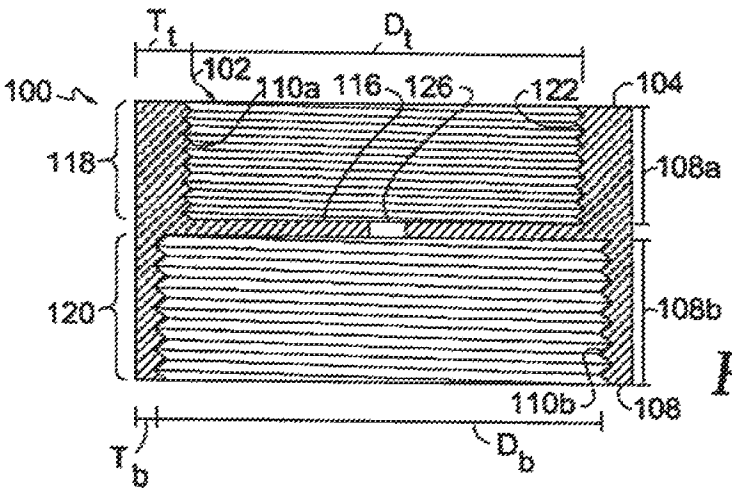
FIG. 4 is a side cross-sectional view of the container fitting shown in FIG. 2 taken along line 4-4.

By way of example, in reference to FIGS. 2 and 3, open top region 118 may by proportioned to accommodate a container mouth having an external diameter of approximately 25 mm while open bottom region 120 may be proportioned to accommodate a container mouth having an external diameter of approximately 35 mm. It should be noted that these mouth diameters are illustrative examples and that the container fitting of the present invention may be proportioned to receive any desired mouth diameter, as long as the top-to-bottom diameters are sized differently, with such additional diameters considered to be within the present invention. The recited diameters are simply those of commonly available water, soft drink and juice or sport/energy drink bottle mouth diameters.

Figure 6:
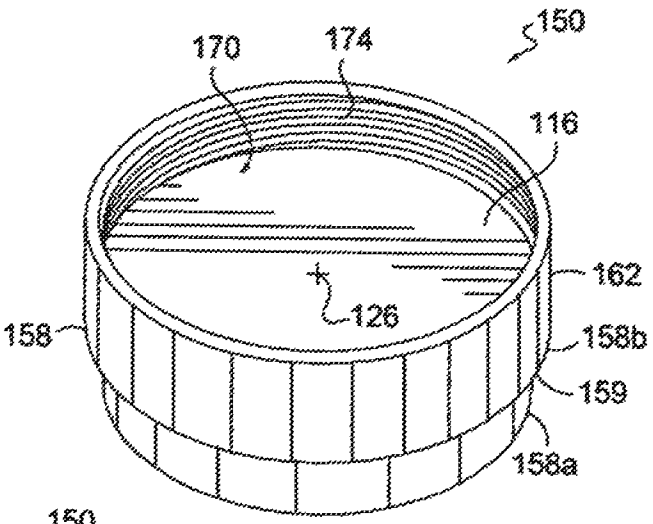
FIG. 6 is a bottom perspective view of the container fitting shown in FIG. 5.
Figure 7:
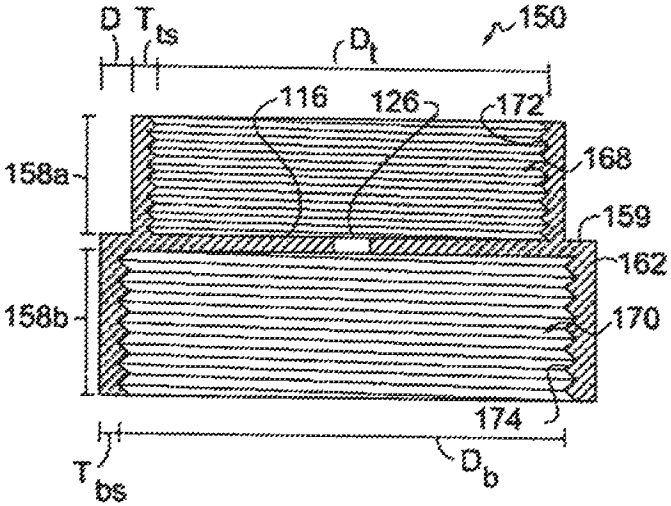
FIG. 7 is a side cross-sectional view of the container fitting shown in FIG. 5 taken along line 7-7.
Figure 5:
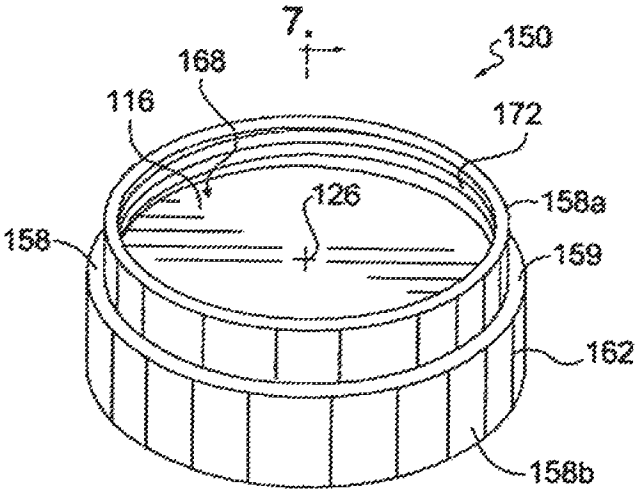
FIG. 5 is a top perspective view an alternative container fitting in accordance with the invention.

Turning now to FIGS. 5 through 7, an alternative embodiment of a container fitting 150 is shown. Container fitting 150 is substantially identical to container fitting 100 described above with the exception that outer surface 162 of side wall 158 is no longer planar but is configured to have a stepped profile having a step portion 159 between top side wall portion 158*a* and bottom side wall portion 158*b*. As described above, container fitting 150 may have an open top region 168 having a smaller open internal diameter $D_t$ than the open internal diameter $D_b$ of open bottom region 170. Similar to open top region 118 and open bottom region 120 described above, open top region 168 may include top threading 172 while open bottom region 170 includes bottom threading 174. In this manner, container fitting 150 may be selectively mountable onto containers 130 which having different mouth diameters. A depth D of step portion 159 may be selected such that top side wall portion 158*a* has a thickness $T_{ts}$ which is substantially similar to a thickness $T_{bs}$ of bottom side wall portion 158*b*. In this manner, the thickness of side wall 158 is consistent between top and bottom side wall portions 158*a*, 158*b*.

Figure 8:
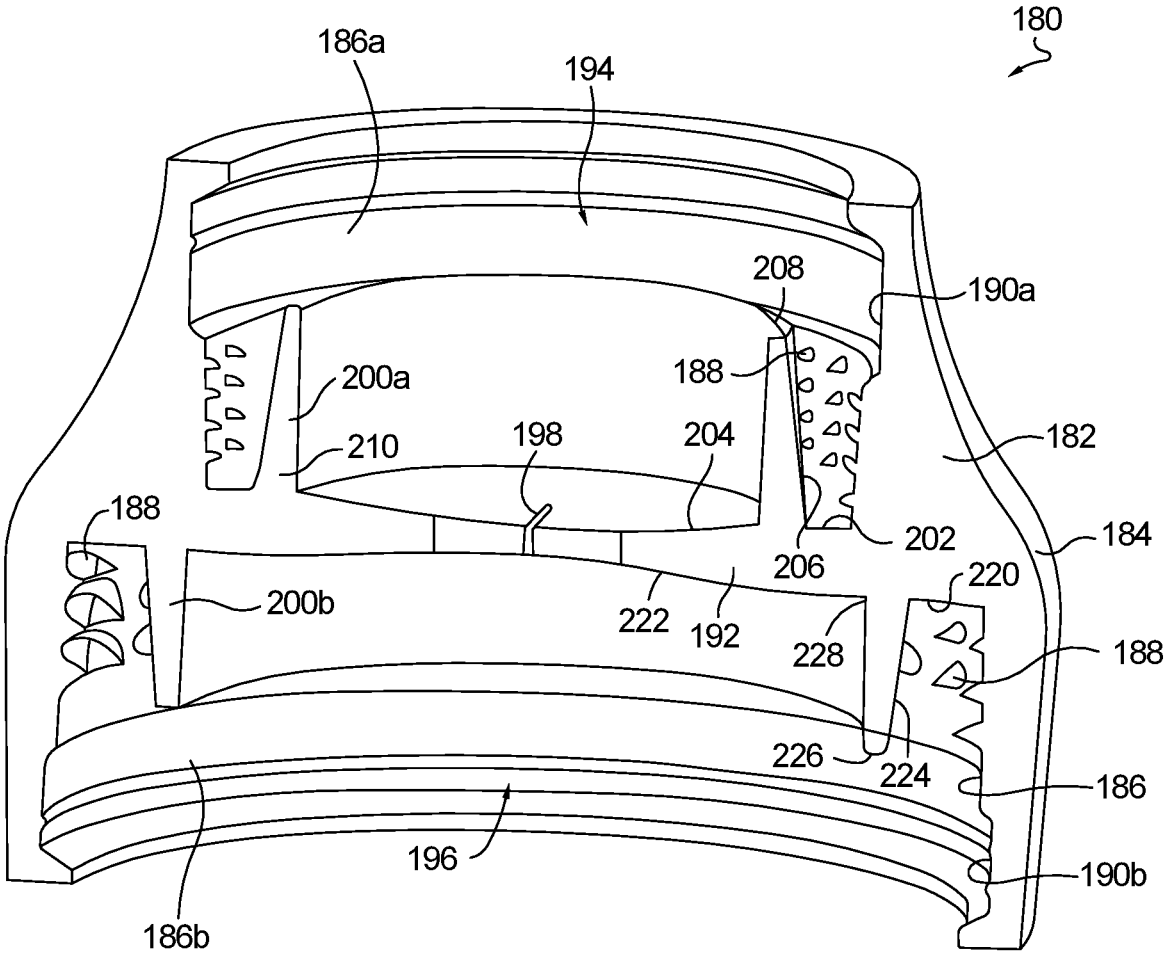
FIG. 8 is a perspective cross-sectional view of an alternative container fitting in accordance with the invention.
Figure 9:
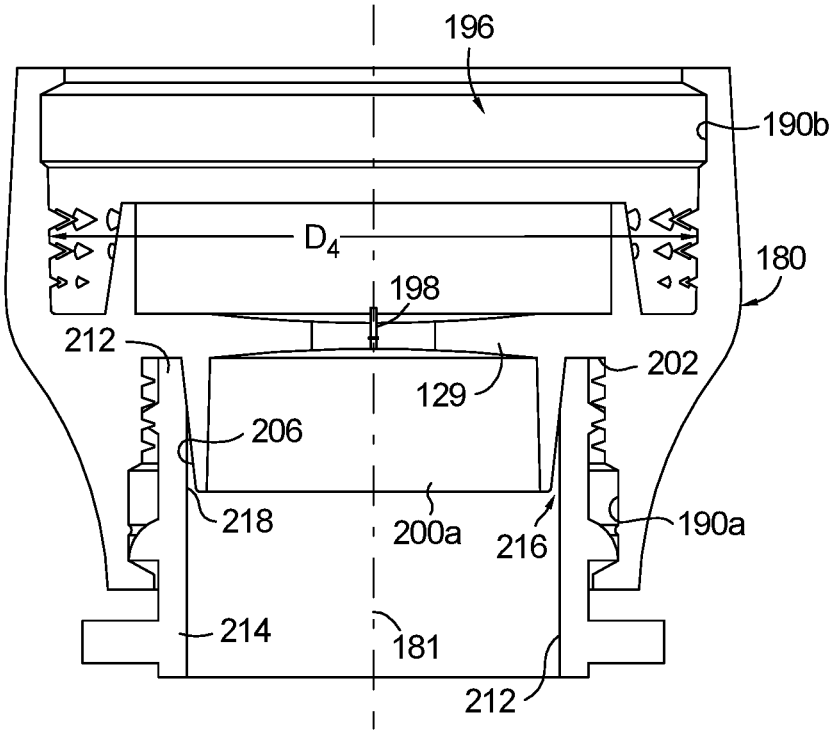
FIG. 9 is a side cross-sectional view of the container fitting shown in FIG. 8 showing the fitting receiving a first receiving container therein.
Figure 10:
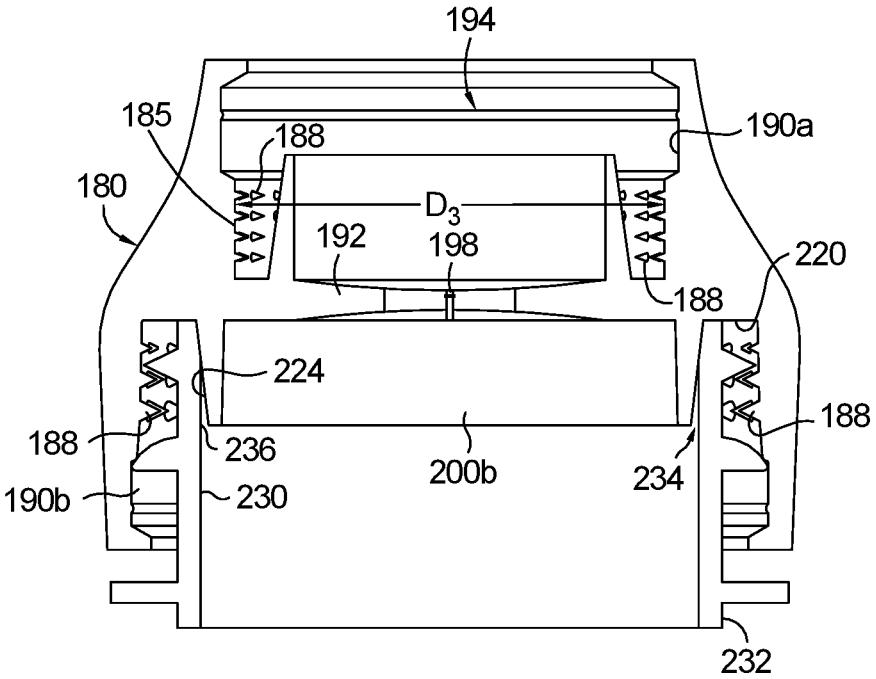
FIG. 10 is a side cross-sectional view of the container fitting shown in FIG. 8 showing the fitting receiving a second receiving container therein.

With reference to FIGS. 8 through 10, an alternative embodiment of a container fitting 180 is shown. Container fitting 180 is similar to container fittings 100, 150 described above but includes a number of additional features. First, side wall 182 defines an outer wall surface 184 which may have a gently curving profile rather than the planar profile of outer surface 112 of container fitting 100 or the stepped profile of outer surface 162 of container fitting 150.

Second, inner surface 186 of side wall 182 includes a number of additional features. Rather than defining continuous threading, such as threading 122/124, 172/174 on container fittings 100, 150, respectively, inner surface 186 includes a plurality of inwardly extending nodes 188 (toward central axis 181 of container fitting 180). In one aspect of the present invention, each node 188 may have a generally conical shape and may be randomly placed about the circumferential surface 185 of inner surface 186. As will be described in greater detail below, when mounting container fitting 180 onto a receiving container, nodes 188 operate in conjunction with one another so as to secure container fitting 180 to the receiving container. Containers currently available may have thread diameters of a common size, such as 28 mm or 38 mm, but the thread pitch and/or threads per inch vastly differ from container to container and are often non-standard making it difficult to provide a "one-size-fits-all" container fitting. By being discontinuous and randomly-spaced, individual nodes, nodes 188 may accommodate non-standard or variable container threading while ensuring threaded engagement of the fitting to the container.

Inner surface 186 may also define a recess, such as recess 190*a*, 190*b*, which is configured to accommodate tamper resistant features formed proximate the mouth opening on the receiving container.

Similar to container fittings 100, 150, container fitting 180 includes a partition 192 integrally formed along inner surface 186 so as to define an open top region 194 and an open bottom region 196. Similar to regions 118, 120 and 168, 170 described above, regions 194 and 196 may define openings of different diameters. As such, regions 194, 196 (and therefore, container fitting 180) may be mounted onto receiving containers have mouths of differing diameters ($D_3$, $D_4$). By way of example and without limitation thereto, region 194 may be proportioned to receive a 28 mm wide container mouth (FIG. 9) while region 196 may be proportion to receive a 38 mm wide container mouth (FIG. 10). Partition 192 may further include an aperture 198 appropriately sized through which a straw, such as standard size disposable straw 128, may close-fittedly pass from the environment, through partition 192 and into the interior of the receiving container, such as container 130 shown in FIG. 1.

Partition 192 may further include a plug seal 200*a*, 200*b* extending perpendicularly outwardly therefrom into open regions 194 and 196, respectively. Plug seal 200*a* may be spaced apart from inner surface 186*a* so as to form a land area seal 202 on surface 204 of partition 192. Plug seal 200*a* may also have a sloped outer wall surface 206 wherein top end 208 of plug seal 200*a* has a smaller thickness than base 210. Thus, as shown most clearly in FIG. 9, as mouth opening 212 of receiving container 214 is threadably mounted to nodes 188 within open top region 194, mouth orifice 216 may seat within land area seal 202 while outer wall surface 206 engages inner wall 218 of mouth opening 212. Or, if mouth orifice 216 cannot seat within land area seal 202, the sloped outer wall surface 206 will tend to wedge the mouth orifice 216 between the sloped outer wall surface and the nodes 188 to tightly grip the container fitting and to enhance its seal. In this manner, receiving container 214 may form a near water-tight seal with container fitting 180 at one or more locations (i.e., engagement office container threads with nodes; seating of mouth orifice against surface 204; and/or inner wall 218 engaging outer wall surface 206).

Similarly, plug seal 200*b* may be spaced apart from inner surface 186*b* so as to form a land area seal 220 on surface 222 of partition 192. Plug seal 200*b* may also have a sloped outer wall surface 224 wherein top end 226 of plug seal 200*b* has a smaller thickness than base 228. Thus, as shown most clearly in FIG. 10, as mouth opening 230 of receiving container 232 is threadably mounted to nodes 188 within open region 196, mouth orifice 234 may seat within land area seal 220 while outer wall surface 224 engages inner wall 236 of mouth opening 230. Or, if mouth orifice 234 cannot seat within land area seal 220, the sloped outer wall surface 224 will tend to wedge the mouth orifice 234 between the sloped outer wall surface and the nodes 188 to tightly grip the container fitting and to enhance its seal. In this manner, receiving container 232 may form a near water-tight seal with container fitting 180 at one or more locations (i.e., engagement office container threads with nodes; seating of mouth orifice against surface 222; and/or inner wall 236 engaging outer wall surface 234).

While the fitting embodiment described above and illustrated in FIGS. 8-10 include a tandem, top opening and a bottom opening configured to be adaptable to different mouth opening sizes, it is understood that the invention, including nodes 188 operating in conjunction with a plug seal, is equally adaptable to a fitting having only one open region for receiving a mouth opening of a particular diameter.

Figure 11:
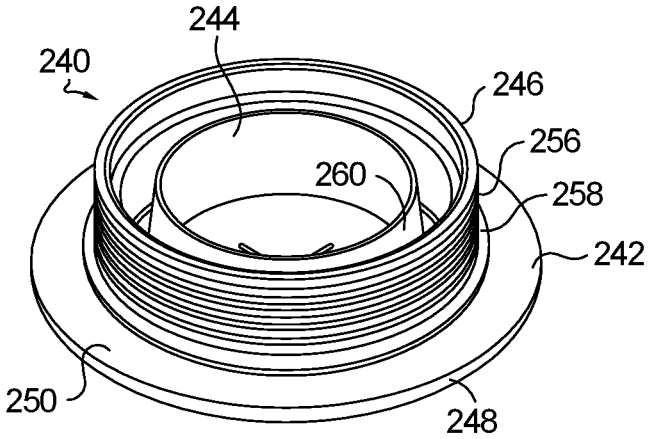
FIG. 11 is a bottom perspective view of an alternative container fitting in accordance with the invention.
Figure 12:
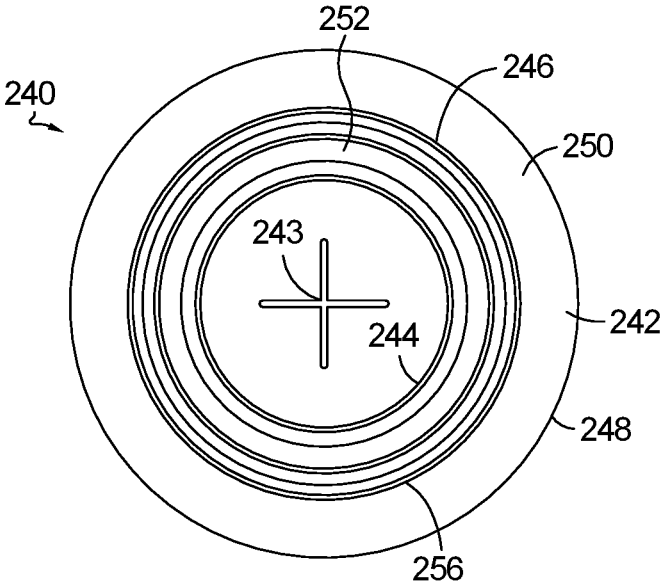
FIG. 12 is a bottom plan view of the container fitting shown in FIG. 11.
Figure 13:
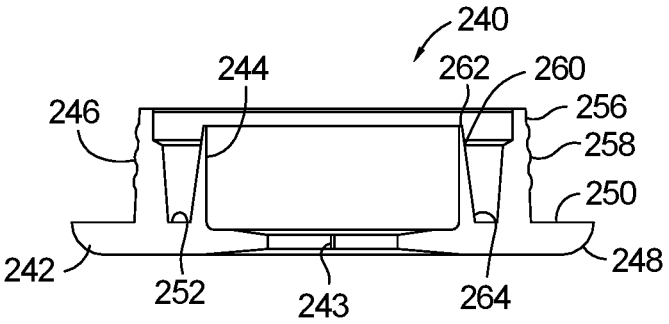
FIG. 13 is a side cross-sectional view of the container fitting shown in FIG. 12 taken along line 13-13.

With reference to FIGS. 11 through 13, an alternative embodiment of a container fitting 240 is shown. Container fitting 240 includes a top panel 242 and two or more side walls, such as inner and outer side walls 244, 246, concentrically arranged about the central axis of the top panel 242. Top panel 242 may further include an aperture 243 appropriately sized through which a straw, such as standard size disposable straw 128, may close-fittedly pass from the environment, through top panel 242 and into the interior of the receiving container.

Outer side wall 246 is arranged a spaced distance from the perimeter edge 248 of top panel 242 so as to define a first land area seal 250. Inner side wall 244 is arranged a spaced distance from outer side wall 246 so as to define a second land area seal 252. The diameter of outer side wall 246 is selected such that outer surface 256 is snuggly received within a mouth opening of a first receiving container whereby outer side wall 246 forms a substantially water tight seal with the container. To improve seal performance, outer surface 256 may include concentric rings 258 so as to define a crenellated or scalloped cross section (FIG. 13). Outer surface 256 may alternately define discontinuous and randomly placed nodes 188 as described above.

Inner side wall 244 may be configured to operate as a plug seal similar to plug seals 200*a*, 200*b* described above with reference to container fitting 180. The inner side wall 144 may include a sloped outer wall surface 260 wherein top end 262 of inner side wall 244 has a smaller thickness than base 264. Thus, as described above, when a mouth opening of a second receiving container is mounted to container fitting 240, the container mouth orifice will seat against second land area seal 252 while outer wall surface 260 engages the inner wall of the container mouth opening. Or, if the mouth orifice cannot seat within land area seal 252, the sloped outer wall surface 260 will tend to wedge the mouth orifice between the sloped outer wall surface and the concentric rings or nodes to tightly grip the container fitting and to enhance its seal. In this manner, the receiving container may form a near water-tight seal with the container fitting at one or more locations.

In accordance with an aspect of the present invention, container fittings 100, 150, 180, 240 may be fabricated as a unitary member. While any suitable material may be used to fabricate container fittings 100, 150, 180, 240, examples of such materials include, but are not limited to silicone, polyethylene, high density polyethylene, low density polyethylene, polyethylene terephthalate, polypropylene, a copolyester and combinations thereof. Container fittings 100, 150, 180, 240 may further be fabricated from colored materials. In accordance with a further aspect of the present invention, container fittings 100, 150, 180, 240 may be fabricated according to a color scheme wherein an individual fitting may be fabricated from a colored material wherein that color is indicative of the mouth diameters to be received by that fitting.

By way of example, a first fitting 100, 150, 180, 240 may be colored red to indicate that open top region 118, 168, 194, inner side wall 244 may receive a 25 mm mouth diameter while open bottom regions 120, 170, 196, outer side wall 246 may receive a 35 mm mouth diameter. A second fitting 100, 150, 180, 240 may then be fabricated in blue to indicate receipt of a 26 mm mouth diameter at the open top region and a 28 mm mouth diameter is receivable in the open bottom region. A user may then visually retrieve a desired fitting without careful interrogation of each individual container fitting, particularly when attempting to visually discern small differences in receivable diameters (i.e. visually discerning between 28 mm and 35 mm) or through attempting to physically mount a suspected container fitting which would require unwanted and premature opening of the container 130 as well as possibly damaging the fitting or bottle mouth opening.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fitting for affixing to a mouth of a receiving container, wherein said mouth includes a thread having a pitch, the fitting comprising a tubular body having a closed top end, a bottom end and a side wall extending between the top and bottom ends and having an inner surface and an outer surface, wherein the inner surface includes a circumferential surface, wherein said circumferential surface includes a plurality of inwardly extending nodes configured to engage said thread of said mouth of the receiving container, and wherein said plurality of inwardly extending nodes are randomly placed about said circumferential surface for engagement with said thread of said mouth to affix said fitting to said receiving container.

2. The fitting in accordance with claim 1 wherein the plurality of inwardly extending nodes are conically shaped.

3. The fitting in accordance with claim 1 further comprising a first plug seal extending outwardly from the closed top end, wherein the first plug seal is spaced apart from the circumferential surface so as to define a first land area seal on said closed top end.

4. The fitting in accordance with claim 3 wherein the first plug seal includes a sloped outer wall surface wherein a top end of the first plug seal has a smaller thickness than a base of the first plug seal.

5. The fitting in accordance with claim 1 wherein said closed top end further includes an aperture therein configured to permit passage of a drinking straw therethrough.

6. A fitting for affixing to a mouth of a receiving container wherein said mouth includes a thread having a pitch, the fitting comprising:

a) a tubular body having a top end, a bottom end and a side wall extending between the top and bottom ends and having an inner surface and an outer surface; and b) a partition integrally formed on the inner surface between the top end and the bottom end, the partition dividing the body into an open top region and an open bottom region, the inner surface of the open top region having a first diameter and the inner surface of the open bottom region having a second diameter wherein the first diameter is smaller than the second diameter, wherein the inner surface of said open top region includes a first circumferential surface, wherein the inner surface of said open bottom region includes a second circumferential surface, wherein at least one of said first or second circumferential surface includes a plurality of inwardly extending nodes configured to engage said thread of said mouth of the receiving container, and wherein said plurality of inwardly extending nodes are randomly placed about said circumferential surface for engagement with said thread of said mouth to affix said fitting to said receiving container.

7. The fitting in accordance with claim 6 wherein the partition further includes an aperture therein configured to permit passage of a drinking straw therethrough from the open top region to the open bottom region.

8. The fitting in accordance with claim 7 wherein the aperture is sized to close fittedly receive a standard size drinking straw.

9. The fitting in accordance with claim 6 further comprising a first plug seal extending outwardly from the closed top end, wherein the first plug seal is spaced apart from the first circumferential surface so as to define a first land area seal on said closed top end.

10. The fitting in accordance with claim 9 further comprising a second plug seal extending outwardly from the partition and into the open bottom region, wherein the second plug seal is spaced apart from the second circumferential surface so as to define a second land area seal on a bottom surface of the partition.

11. The fitting in accordance with claim 9 wherein the first plug seal includes a sloped outer wall surface wherein a top end of the first plug seal has a smaller thickness than a base of the first plug seal.

12. The fitting in accordance with claim 6 wherein the open top end accommodates a container mouth having a diameter of one of approximately 25 mm or approximately 35 mm wherein the open bottom end accommodates a container mouth having an external diameter of one of approximately 25 mm or approximately 35 mm other than the one accommodated by the open top end.

13. The fitting in accordance with claim 6 wherein a respective recess is defined within the inner surface of the side wall proximate the top end and the bottom end, wherein the recess is configured to receive a tamper resistant feature defined on the receiving container.

14. The fitting in accordance with claim 6 wherein the fitting is selectively colorized to identify the diameter of the container mouth that the open top end and open bottom end of fitting is configured to receive.

15. A fitting for affixing to a mouth of a receiving container, wherein said mouth of said receiving container includes a thread having a pitch, the fitting comprising a body having a central axis, a closed top end, a bottom end and first and second side walls extending concentrically from the closed top end, wherein said closed top end includes an inner face, wherein said first side wall includes a first surface and said second side wall includes a second surface facing said first surface of said first side wall, wherein said first side wall is spaced apart from said second side wall to form a land area seal surface on said inner face of said closed top end, wherein said first surface is sloped relative to said central axis, and wherein a near water-tight seal is formed between the receiving container mouth and said first surface, said second surface and said land area seal, and wherein said second surface of said second side wall includes a plurality of randomly spaced and inwardly extending nodes configured to engage said thread of said mouth when said fitting is affixed to said receiving container.

* * * * *